United States Patent [19]

Urban et al.

[11] Patent Number: 4,578,202

[45] Date of Patent: Mar. 25, 1986

[54] CUTTING OIL FOR WORKING NONFERROUS METALS BY CUTTING

[75] Inventors: Manfred Urban, Weiterstadt; Dieter Schmitt, Darmstadt, both of Fed. Rep. of Germany

[73] Assignee: Merck Patent Gesellschaft mit beschrankter Haftung, Darmstadt, Fed. Rep. of Germany

[21] Appl. No.: 564,458

[22] Filed: Dec. 22, 1983

[30] Foreign Application Priority Data

Dec. 22, 1982 [DE] Fed. Rep. of Germany ..... 3247426

[51] Int. Cl.[4] ..... C10M 105/08; C10M 105/22; C10M 105/72

[52] U.S. Cl. ..... 252/33.4; 252/56 S; 72/42

[58] Field of Search ..... 252/56 S, 33.4; 72/42

[56] References Cited

U.S. PATENT DOCUMENTS

| | | | |
|---|---|---|---|
| 2,443,833 | 6/1948 | Myers | 252/56 S |
| 2,620,307 | 12/1952 | Stewart | 252/56 S |
| 3,761,410 | 9/1973 | Mondshine | 252/56 R |
| 3,933,660 | 1/1976 | Tadenuma et al. | 252/33.4 |
| 4,253,981 | 3/1981 | Ayres | 252/56 S |
| 4,440,660 | 3/1984 | Van Rijs | 252/56 S |

*Primary Examiner*—John F. Niebling
*Attorney, Agent, or Firm*—Millen & White

[57] ABSTRACT

A cutting oil suitable for the working of nonferrous metals, in particular for milling and engraving copper cylinders employed in gravure printing, is based on fatty acid esters of monohydric or polyhydric alcohols in an organic solvent which is selected from glycols, oligoglycols, polyglycols or their monoethers, diethers, monoesters or diesters, and also contains a surfactant, preferably an anionic surfactant. This oil enables outstanding and trouble-free working of metals and is distinguished by being completely removable, without regreasing, in an alkaline degreasing bath.

18 Claims, No Drawings

CUTTING OIL FOR WORKING NONFERROUS METALS BY CUTTING

BACKGROUND OF THE INVENTION

This invention relates to a new cutting oil useful for the working of nonferrous metals by cutting. In particular, it relates to a cutting oil for milling and/or engraving copper cylinders employed in gravure printing.

There is a great demand for efficient cutting oils for the working of metals, in particular nonferrous metals, by cutting, such as lathing, milling, boring, sawing, cutting and grinding. These oils serve as coolants and lubricants and have the purpose of ensuring problem-free working of the workpiece. In particular, they should enable the cutting tool to slip easily over the workpiece and the heat generated locally during the cutting to be removed. They also should prevent corrosion of the worked surface of the metal and wearing of the tool. (See, e.g., Ullmann's Enzyklopaedie der technischen Chemie (Ullmann's Encyclopedia of Industrial Chemistry), 4th edition, volume 20, pages 617–622, 1981).

In gravure printing, the print image is engraved on the outer surface of the copper impression cylinder in the form of corresponding depressions. These depressions take up the printing ink during the printing operation, and the ink is then transferred from the rotating cylinder onto the material to be printed. When printing has ended, this outer engraved layer of copper is removed from the used cylinder by a milling operation. A new print image is then engraved in the fresh surface and this is coppered or chromed in order to achieve a higher mechanical strength (necessary in the case of high print runs).

The mentioned milling operation predominantly uses a special apparatus which mills the outer layer of metal, which is no longer required, from the rotating copper cylinder with high precision by means of a high-speed milling disk fitted with cutting diamonds.

This process requires a cutting oil which should fulfill the following requirements:

1. It should enable problem-free working of the impression cylinder, i.e.,
   - (a) formation of an oil film which adheres well and does not break even during the milling operation and the relatively high temperatures thereby produced,
   - (b) production of an absolutely smooth, new surface by correspondingly good lubrication of the cutting tool,
   - (c) good removal of heat from the worked metal surface and the cutting tool,
   - (d) prevention of agglomeration of the milled metal particles, especially on the cutting tool, and
   - (e) prevention of corrosion of the fresh metal surface and of rapid wear of the cutting tool.
2. During subsequent engraving of the copper cylinder, the gliding foot of the engraving unit must slide perfectly over the cutting oil film.
3. After the engraving, it must be possible to remove the cutting oil film completely in an alkaline degreasing bath. Only then is there ensured a sufficient adhesion of the layer of metal applied during subsequent coppering or chroming of the engraved surface of the impression cylinder and hence a high print run of constant print quality.

The cutting oils hitherto used according to the prior art usually consist of a natural fat, i.e., a glycerol ester of natural, partially unsaturated fatty acids (content in the cutting oil: about 50% by weight), dissolved in chlorinated hydrocarbons (usually a mixture of methylene chloride and trichloroethane).

The disadvantages of this oil are many. For example:

A. An impression cylinder treated with this product can be degreased completely only with great difficulty. Especially at the edges of the cylinder, removal of the oil by the degreasing bath is only incomplete. This leads to poor adhesion of the freshly deposited copper or chromium layers. Cylinder and machine damage and thus, finally, lower print runs and poorer print quality result.

B. Because of the content of chlorinated hydrocarbons of high vapor pressure, the cutting oil according to the prior art is a health hazard. Application of the cutting oil as a thin film to the cylinder also promotes evaporation. Thus, the personnel employed in this operation are exposed to a high level of chlorinated hydrocarbons in the air which they breath. Frequently, the level reaches a point where it is no longer tolerable.

C. The high-speed milling disk (up to about 10,000 revolutions per minute) causes misting of the cutting oil. This leads to undesirable pollution of the work station and an odor nuisance to the personnel employed there. There also results further deterioration and danger from the spray mist and the oil precipitated.

SUMMARY OF THE INVENTION

Accordingly, it is an object of this invention to provide a cutting oil useful for the working of nonferrous metals by cutting, in particular for milling and engraving copper cylinders employed in gravure printing.

It is another object of this invention to provide such an oil which fulfills the requirements described above and does not have the above-mentioned disadvantages or possesses them to a significantly lesser degree.

Upon further study of the specification and appended claims, further objects and advantages of this invention will become apparent to those skilled in the art.

Surprisingly, it has now been found that these objects are achieved by providing a cutting oil which contains glycols, oligoglycols, polyglycols or monoethers, diethers, monoesters or diesters thereof as solvents and a surfactant.

The present invention thus relates to a cutting oil which is based on fatty acid esters of monohydric or polyhydric alcohols and which is useful for the working of nonferrous metals by cutting, in particular for milling and/or engraving copper cylinders employed in gravure printing, and which further comprises glycols, oligoglycols, polyglycols or their monoethers, diethers, monoesters or diesters, as solvents (liquid at room and storage temperatures, at least at 0° C.), and a surfactant, preferably an anionic surfactant.

This invention furthermore relates, in a process for the working of nonferrous metals by cutting, in particular a process for milling and/or engraving copper cylinders employed in gravure printing, using a cutting oil, to the improvement wherein the cutting oil of this invention is used.

The invention moreover relates to the use of the cutting oil according to this invention in the working of nonferrous metals by cutting, in particular in the milling and/or engraving of copper cylinders employed in gravure printing.

DETAILED DISCUSSION

The cutting oil contains fatty acid esters of monohydric or polyhydric alcohols, preferably of glycerol, in an amount of 20–80 percent by weight, preferably 40–60 percent by weight, (herein, based on the total weight of oil). Suitable such components include esters of fatty acids containing 12–22 carbon atoms, generally derived from natural oils, fats and waxes.

Fatty acid esters which are as saturated as possible and which may be hardened, are preferred. Thereby, the stability of the cutting oil to storage and oxidation is increased and its tendency towards resinification is reduced. This tendency is a disadvantage of cutting oils according to the prior art which are based on natural fats since they have a varying content, in some cases even a relatively high content, of unsaturated fatty acids. In these fatty acid esters, the alcohol component is usually a $C_{1-3}$-hydrocarbon saturated alcohol generally containing 1–3 hydroxy groups, most preferably glycerol. The hydroxy groups of these alcohols usually are partly, most preferably fully esterified, by monofatty acids containing 12–22 carbon atoms, most preferably fully or predominantly saturated. Suitable such fatty acid esters include natural or modified oils and fats, e.g., castor oil, palm oil, coconut oil, coconut grease, and the like.

The cutting oil contains glycols, oligoglycols, polyglycols or their monoethers, diethers, monoesters or diesters in an amount of 20–80 percent by weight, preferably 40–60 percent by weight, as solvents according to this invention. These solvents are chosen in accordance with the following guidelines.

(a) The solvents used should have a sufficient dissolving power for the fat, even in the region of relatively low temperatures (e.g., 0°–15° C.), and should have a freezing point below 0° C. so that the cutting oil does not solidify during transportation or prolonged storage at low temperatures.

(b) The solvents should have as high a flashpoint as possible, in order to exclude the danger of ignition during the milling operation and the relatively high temperatures thereby occurring. Flashpoints above about 80° C. have proved to be acceptable.

Suitable solvents according to this invention include virtually any desired glycols, oligoglycols and polyglycols and their monoethers, diethers, monoesters and diesters, as well as mixed ether-ester derivatives, which have weight average molecular weights of about 100 to 600 preferably and fulfill the above-mentioned criteria. Customary solvents of this type include the lower homologs of ethylene glycol and propylene glycol ($C_{2-4}$-hydrocarbon aliphatic glycols), and their oligo- and polymeric forms (molecular weights: 90–300, or 2–4 monomer units), and derivatives of these compounds in which one or both hydroxyl groups are etherified and/or esterified. Suitable etherifying groups include alkyl groups of 1 to 4 C. atoms, phenyl or benzyl and suitable acyl radicals for esterification include those of alkanecarboxylic acids of up to 4° C. atoms or benzoyl.

Diethylene glycol dibutyl ether, dipropylene glycol monomethyl ether, tripropylene glycol monomethyl ether and tetraethylene glycol are preferably used as solvents according to this invention.

The cutting oil contains surface-active agents in an amount of 0.01–5 percent by weight, preferably 0.1–1 percent by weight, as the surfactant additive according to this invention.

The choice of suitable surfactants is largely not critical for achieving the desired effect of improved removal of the cutting oil from the worked metal. In principle, all the customary cationic or anionic, nonionic or amphoteric surfactants are suitable. Anionic surfactants are advantageous for removing the cutting oil film with an alkaline degreasing bath. They therefore are preferred since their surface-active action is most effective in an alkaline medium. Suitable surfactants include soaps, alkane-, olefin- and estersulfonates, in particular alkylbenzenesulfonates, and alky-, ether-, fatty alcohol- and fatty ether-sulfates. Those skilled in the art can select suitable surfactants from the large number of substances available by simple routine testing.

Thus, for example, sodium dodecylbenzenesulfonate, sodium cetyl ether-sulfate, sodium lauryl sulfate or corresponding commercially available products, such as, for example, a sodium salt of a fatty acid condensation product (Lutensit® A-FK from BASF AG) can be added, for example, to the cutting oil as the surfactant. The cutting oils of the invention can also contain other conventional additives including e.g., stabilizers, antioxidants, in amounts of 0.01–5 weight percent.

The cutting oil according to this invention is distinguished by the fact that it fulfills requirements 1–3 above very well. In particular, however, its removal by an alkaline degreasing bath from a metal surface treated with the cutting oil is outstanding and complete. This is documented in one of the examples which follow. Accordingly, especially in use according to this invention during milling and engraving of copper cylinders employed in gravure printing, it can be removed completely, even from the edges of the cylinders, by the degreasing bath. Moreover, no re-greasing of the cylinder from the bath occurs. This leads to longer lives of the baths.

The cutting oil according to this invention contains no substances which are a health hazard. In contrast to the cutting oils of the prior art, it also has virtually no troublesome intrinsic odor at all.

Surprisingly, it has also been established that, when the cutting oil is used according to this invention during milling and engraving of copper cylinders employed in gravure printing, no misting at all of the cutting oil by the high-speed milling disk occurs. This means that undesirable contamination of the work station and adverse annoyance and danger to the personnel employed there is avoided. Other typical metals which can be worked per this invention include aluminium, chromium and various nonferrous alloys.

Unless indicated otherwise herein, the use of the cutting oils of this invention is fully conventional and analogous to the use of conventional cutting oils taking into consideration the advantages mentioned above.

Without further elaboration, it is believed that one skilled in the art can, using the preceding description, utilize the present invention to its fullest extent. The following preferred specific embodiments are, therefore, to be construed as merely illustrative, and not limitative of the remainder of the disclosure in any way whatsoever. In the following examples, all temperatures are set forth uncorrected in degrees Celsius; unless otherwise indicated, all parts and percentages are by weight.

Examples 1–4 illustrate cutting oils according to this invention. Example 5 shows, in a comparative degreasing experiment, the particular advantages of the cutting oil according to the prior art. It is found that, as a result of the content of solvent according to this invention, the minimum treatment time with a degreasing bath is reduced to less than half of that required with a cutting oil according to the prior art, and to about 1/10 if a surfactant according to the invention is present at the same time.

EXAMPLE 1

A cutting oil consists of
40% of castor oil,
59.5% of diethylene glycol dibutyl ether, and
0.5% of sodium dodecylbenzenesulfonate.

EXAMPLE 2

A cutting oil consists of
50% of palm oil,
49.8% of dipropylene glycol monomethyl ether, and
0.2% of sodium cetyl ether-sulfate.

EXAMPLE 3

A cutting oil consists of
45% of coconut oil,
54% of tetraethylene glycol, and
1% of sodium lauryl sulfate.

EXAMPLE 4

A cutting oil consists of
56% of coconut grease,
43.8% of tripropylene glycol monomethyl ether, and
0.2% of the sodium salt of a fatty acid condensation product (Lutensit® A-FK from BASF AG).

EXAMPLE 5

Degreasing experiment

In each case, one drop of the cutting oil to be tested is applied to a clean copper foil. The foils are then dried at 100° C. for 2 minutes.

When the foil samples are now immersed in a customary alkaline degreasing solution (e.g., consisting of 50 g of Unilever SU 170 in 600 g of water), the drops lift off after varying intervals of time and dissolve:

| | |
|---|---|
| Cutting oil according to Example 4 | 13 seconds |
| Cutting oil according to Example 4, but without surfactant | 50 seconds |
| Cutting oil according to the prior art (about 50% of naturally occurring partially unsaturated fat; remainder: chlorinated hydrocarbons) | over 120 seconds |

The preceding examples can be repeated with similar success by substituting the generically or specifically described reactants and/or operating conditions of this invention for those used in the preceding examples.

From the foregoing description, one skilled in the art can easily ascertain the essential characteristics of this invention, and without departing from the spirit and scope thereof, can make various changes and modifications of the invention to adapt it to various usages and conditions.

What is claimed is:

1. A cutting oil useful for the working of nonferrous metals by cutting, consisting essentially of effective amounts of (a) a fatty acid ester of a monohydric or polyhydric $C_{1-3}$-alcohol, (b) a solvent which is a $C_{2-4}$-glycol, or an oligoglycol or a polyglycol thereof, or a monoether or diether thereof with a $C_{1-4}$-alkyl group, phenyl or benzyl, or a monoester or diester thereof with $C_{1-4}$ alkanoyl or benzoyl, and which is liquid at room temperature, and (c) a surfactant effective to solubilize or disperse the cutting oil in an alkaline degreasing bath.

2. A cutting oil of claim 1 wherein the surfactant is an anionic surfactant.

3. A cutting oil of claim 2 wherein the surfactant is a soap, an alkane-, olefin- or ester-sulfonate or an alkyl-, ether-, fatty alcohol- or fatty ether-sulfate.

4. A cutting oil of claim 1, comprising 20–80% of fatty acid ester (a), 20–80% of solvent (b) and 0.01–5% of surfactant (c).

5. A cutting oil of claim 2 wherein the amounts of ingredients are: (a) 40–60 percent by weight, (b) 40–60 percent by weight and (c) 0.1–1 percent by weight.

6. A cutting oil of claim 1 wherein fatty acid ester (a) is substantially completely saturated.

7. A cutting oil of claim 1 wherein the fatty acid ester (a) is a$C_{12-22}$-fatty acid ester of a $C_{1-3}$alkane alcohol of 1–3 hydroxy groups.

8. A cutting oil of claim 1 wherein the solvent (b) dissolves component (a) at a temperature of 0°–15° C., has a freezing point below 0° C., and has a flashpoint above about 80° C.

9. A cutting oil of claim 8 wherein the solvent (b) is a $C_{2-4}$-glycol or an oligomer or polymer thereof of 2–4 monomeric components, or an ether, diether, ester or diester thereof.

10. A cutting oil of claim 9 wherein the solvent (b) is diethylene glycol dibutyl ether, dipropylene glycol monomethyl ether, tripropylene glycol monomethyl ether or tetraethylene glycol.

11. In a process for working a nonferrous metal by cutting, comprising applying a cutting oil to the metal at the cutting site, the improvement wherein the cutting oil is that of claim 1.

12. A process of claim 11 wherein the metal being cut is copper.

13. A process of claim 12 comprising milling or engraving a copper cylinder useful for gravure printing.

14. A process of claim 11 further comprising, after cutting, degreasing the metal in an alkaline degreasing bath.

15. A process of claim 14 wherein, in the cutting oil, the surfactant is an anionic surfactant.

16. In a process of degreasing a nonferrous metal which has been treated with a cutting oil, comprising contacting the metal with an alkaline degreasing bath, the improvement wherein the cutting oil is one of claim 1.

17. In a process of degreasing a nonferrous metal which has been treated with a cutting oil, comprising contacting the metal with an alkaline degreasing bath, the improvement wherein the cutting oil is one of claim 2.

18. A cutting oil of claim 1 wherein by said selection of ingredients (a)–(c), after being used in said working of non-ferrous metals, said cutting oil is removable from the surface of the metal by an alkaline degreasing bath.

* * * * *